250-506.1 SR
OR 3,934,152

United S
Alleaume

[11] 3,934,152
[45] Jan. 20, 1976

[54] ENCLOSURE FOR CONFINING RADIO-ACTIVE PRODUCTS OR WASTE

[75] Inventor: Jean Alleaume, Saint Cloud, France

[73] Assignee: Technigaz, Paris, France

[22] Filed: Dec. 6, 1973

[21] Appl. No.: 422,415

[30] Foreign Application Priority Data

Dec. 13, 1972 France ..... 72.44346

[52] U.S. Cl. ..... 250/506; 250/515; 250/517
[51] Int. Cl. ..... G21f 7/00
[58] Field of Search ..... 250/505, 506, 507, 515, 250/517; 252/301.1 W

[56] References Cited

UNITED STATES PATENTS

| | | | |
|---|---|---|---|
| 3,046,403 | 7/1962 | Montgomery | 250/507 |
| 3,663,817 | 5/1972 | Sayers | 250/506 X |

*Primary Examiner*—James W. Lawrence
*Assistant Examiner*—Davis L. Willis
*Attorney, Agent, or Firm*—Kenyon, Kenyon Reilly Carr & Chapin

[57] ABSTRACT

An enclosure for confining radio-active products or waste comprising a fluid-tight underground rigid supporting outer shell of reinforced concrete opening to the outside through a reinforced concrete chimney, an innermost vessel for containing said radioactive products or waste, surrounded by said shell and made from thin corrugated stainless steel sheet material, an intermediate vessel made from thin corrugated stainless steel sheet material, located between said shell and innermost vessel and surrounding the latter, means for cooling said vessels through fluid flow circulation by natural convection within ducts adjacent to at least one of said vessels and means for feeding and/or discharging said radio-active products or waste into or from said innermost vessel.

15 Claims, 11 Drawing Figures

ENCLOSURE FOR CONFINING RADIO-ACTIVE PRODUCTS OR WASTE

The present invention relates essentially to an enclosure for confining radio-active waste or products which are stored within tanks, containers, vats or like vessels or within silos, bunkers or like store-pits buried in the ground.

According to the present regulations radio-active waste is at first stored for ten years in the state of a liquid such as for instance a concentrated acid solution or an alkaline solution, this ten years period corresponding to a quick degeneracy or decay of the radio-active waste. The latter is usually contained within self-supporting metal vessels, tanks, shells or like casings located within underground enclosures made from reinforced concrete. In the case of products or waste exhibiting a strong radio-activity there is usually provided one or two self-supporting stainless steel envelopes positioned within a reinforced concrete vault and these envelopes are cooled from the outside or the inside through forced water flow circulation for instance by means of coils extending within the inside of the vaults or envelopes into the radio-active waste or by providing a natural or forced water flow circulation at the outside of these envelopes.

As radio-active liquid waste exhibits a relatively low radio-activity only it is presently contained within a self-supporting metal vessel positioned in turn within a carbon steel tank which forms an inner lining, facing or like covering of a reinforced concrete casing or shell buried in the ground. A forced or natural circulation of water is caused to flow through the intermediate space left between the first self-supporting vessel holding the radio-active waste and the carbon steel tank.

At the end of this ten years period the liquid radio-active waste is artificially converted into powdery solid materials which have to be confined, kept in or stored for 500 years. This solid waste is presently stored within cylindrical self-supporting stainless steel silos or like bunkers such as those assuming the shape of vertical columns which are located within buried concrete vaults and cooled through natural or forced circulation of air.

These known devices for confining radio-active products or waste exhibit a number of significant drawbacks. In particular carbon steel tanks in which are located the self-supporting metal vessels or containers holding the radio-active waste are sensitive to corrosion and may therefore become cracked or broken or undergo failure in course of time during the ten years period. In addition the self-supporting vessels or containers are made from stainless steel and have walls of a relatively large thickness so that they are particularly expensive.

These stainless steel vessels or containers are moreover found to be exposed to break hazards owing to the presence of hot spots due to settling or like deposition of the sludges or slurries, precipitates, deposits present in suspension in the liquid radio-active waste. The cooling devices or systems usually employed also suffer from drawbacks since the cooling coils located in some cases inside of the vessels holding the radio-active waste may become cracked whereby the radio-active waste then contaminates the cooling water and such a contamination is likely to be conveyed or spread to the outside of the confining enclosure. In addition in the case where forced circulation of cooling water is used the life times of the pumps used are not long enough so that there are risks of break-down, failure and leakage hazards. The operation of these pumps also requires an outer power source.

As to the cylindrical silos or bunkers in which the solid radio-active waste is confined for 500 years they incur risks of breaking or failure hence a hazard of contamination by radio-active dust carried along by the cooling air. These silos or bunkers are of self-supporting structure and therefore formed with thick stainless steel walls so that they are also particularly costly.

The object of the present invention is accordingly to avoid all the aforesaid inconveniences of the devices known from the prior state of the art and it proposes for this purpose an enclosure for confining radio-active products or waste which is characterized in that it comprises in combination a substantially fluid-tight or sealed rigid outer supporting shell structure made from reinforced concrete and buried in the ground and opening to the outside by means of a chimney-stack made of reinforced concrete, a first vessel or tank holding said radio-active products or waste which forms a primary barrier and consists of thin corrugated stainless steel sheet material formed for instance with two orthogonally intersecting series of parallel spaced corrugations, a second vessel or tank forming a secondary barrier made from thin corrugated steel for example stainless steel sheet material formed for example with two orthogonally intersecting series of parallel spaced corrugations and which is located between said rigid supporting shell structure and said first vessel, means for cooling said vessels through fluid circulation induced by natural convection within channels or ducts adjacent to at least one of said vessels and means for feeding and/or discharging said radio-active products or waste into or from said first vessel.

A particularly significant advantage of the invention is therefore the fact that the radio-active products or waste are contained within a stainless steel vessel having a corrugated thin wall and which is surrounded or enclosed by a second vessel having also a thin corrugated wall, both of these vessels being carried by a rigid supporting shell structure made from reinforced concrete such as a vault or like casing buried in the ground. The vessels, tanks or like containers used according to the present invention are therefore of a substantially lower cost price than the self-supporting vessels used in the prior state of the art and moreover they do no longer incur the risks of becoming cracked and subjected to breaks or failures due to the presence of hot spots since the thin corrugated walls forming said vessles may sustain local deformations or strains due to being irregularly heated and which are caused by the deposits of settlings of the precipitates contained within the radio-active liquid.

The invention is thus also applicable to the provision of enclosures for confining radio-active liquid products for ten years and enclosures for confining or holding radio-active products in powdery condition for 500 years.

According to another characterizing feature of the invention the corrugations of said first and second vessels are directed radially to project inwards and outwards, respectively, from said confining enclosure and cooling fluid circulation channels or ducts are located between said vessels in substantially parallel relationship with each other and consist of stainless steel ducts or pipes forming in the longitudinal direction radially overlying fluid feed and return channels, the cold fluid feed or supply ducts being adjacent to the wall of said second vessel, the hot fluid return ducts being adjacent to said vessel.

The cooling channels are thus located outside of the vessel holding the radio-active products or waste and are therefore unable to cause any contamination when they become broken or cracked or are subject to failure.

According to a further characterizing feature of the invention the corrugations of said vessels are directed radially to project inwards from said confining enclosure and fluid circulation channels are arranged substantially vertically adjacent to the outer wall of said second vessel between said rigid supporting shell structure made from reinforced concrete and said second vessel.

The flow circulation channels are in this case located outside of both vessels and may not either result in any contamination when they become broken or cracked or have undergone any failure.

The circulation of the cooling fluid or fluids is therefore carried out in every case through natural convection without any extraneous power supply.

The invention will be better understood and other objects, characterizing features, details and advantages therof will become apparent as the following explanatory description proceeds with reference to the accompanying diagrammatic drawings given by way of non-limiting examples only illustrating several presently preferred specific forms of embodiment of the invention and wherein:

FIG. 10 is a view in longitudinal section of a second embodiment of the invention as applied to the confinement for 500 years of radio-active waste as powdery solid materials.

Reference should be first made to FIGS. 1 through 9 in which has been shown a first embodiment of the invention serving for the confinement of radio-active products or waste in a liquid state such as concentrated acid solutions or alkaline solutions having a rather high radio-activity. These radio-active products are enclosed for ten years within this enclosure, this time period corresponding to a quick degeneracy of decay of these products and to a corresponding significant lowering or decrease in radio-activity.

Figure 1:
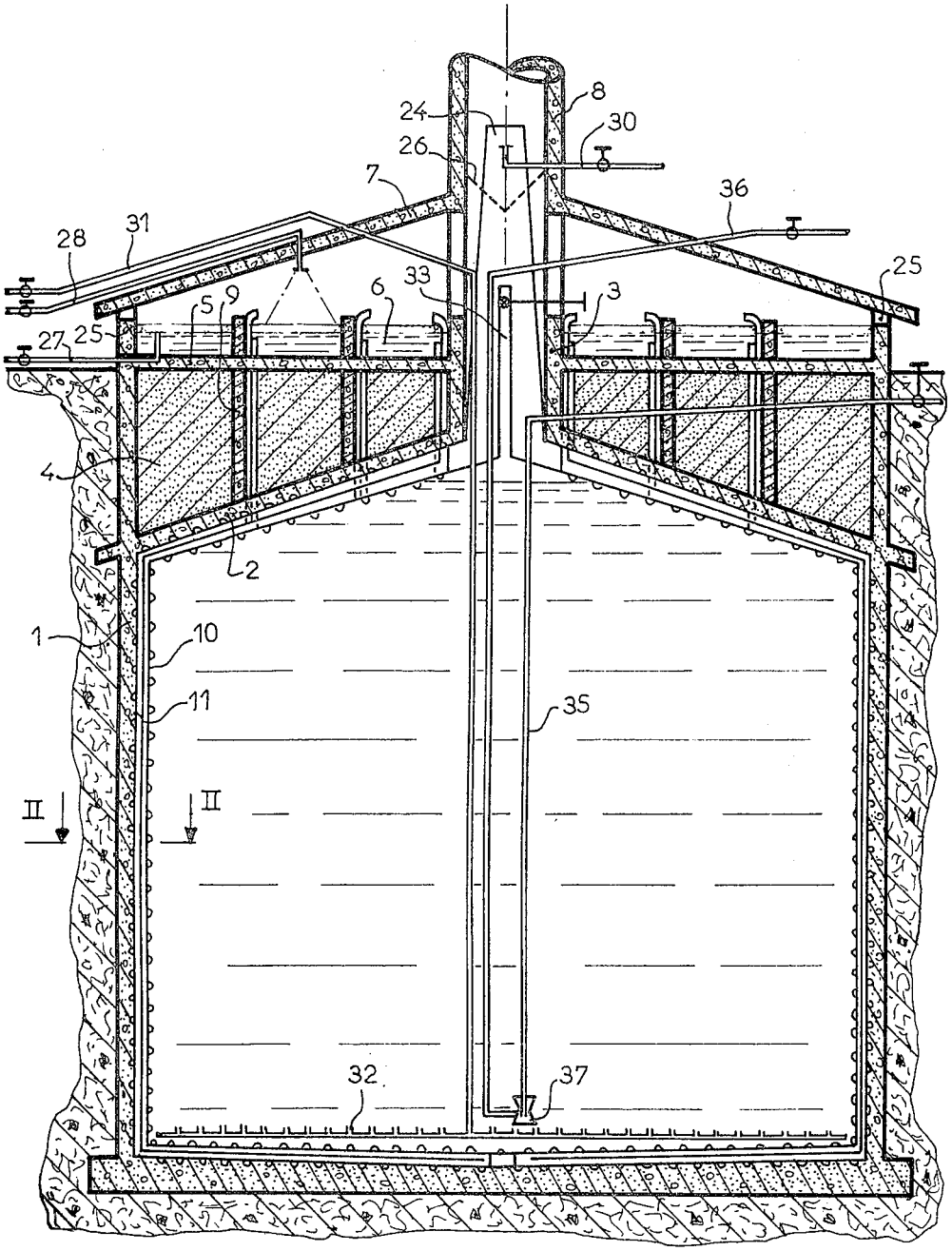
FIG. 1 shows a view in vertical section of a first embodiment of the invention applied to the confinement for ten years of liquid waste exhibiting strong radio-activity.

The confining enclosure shown in FIG. 1 comprises a first outer shell or casing 1 made from reinforced or prestressed concrete which is buried in the ground and the lower part of which assumes in the present instance a substantially cylindrical shape. The outer shell or casing 1 forms the rigid supporting structure for the vessels or containers holding the radio-active products or waste in the liquid state and it comprises a first roof or celing 2 located at some distance below ground level and in the middle of which is formed the lower portion, bottom or base 3 of a substantially cylindrical chimney-stack, funnel or flue opening to the outside. A layer of insulating material 4 such as dry sand is positioned between the roof 2 and a substantially horizontal intermediate reinforced concrete partition wall 5 located about at the outer ground level. A basin or pool 6 forming a cooling water storage tank is provided between this intermediate partition 5 and a second roof or ceiling 7 lying above ground level and in the middle of which is formed the upper portion or top section 8 of said chimney-stack. Substantially vertical supporting pillars or like uprights 9 extend from the lower roof 2 up to above the free surface of the water contained in the pool or basin 6 and support the intermediate partition 5 forming the bottom of the basin.

The radio-active products or waste in liquid state are contained within a first vessel 10 forming a primary barrier which consists of a thin corrugated stainless steel sheet formed for instance with two orthogonally intersecting series of spaced parallel corrugations. A second vessel 11 forming a secondary barrier and which is also advantageously made from a thin corrugated stainless steel sheet formed for instance with two orthogonally intersecting series of spaced parallel corrugations is placed about the first vessel 10 between this first vessel 10 and the rigid supporting shell structure 1. The corrugations of the first vessel 10 are directed radially to project inwards from the confining enclosure whereas the corrugations of the second vessel 11 are directed radially to project towards the opposite direction, i.e. outwards of said enclosure and substantially vertical channels for cooling fluid circulation are provided in the space separating both vessels 10 and 11 from one another. This arrangement is shown in more detail in FIGS. 2 and 3.

The cooling fluid flow channels consist advantageously of stainless steel ducts 12 which are arranged in parallel relationship with each other between the vessels 10 and 11 and which form longitudinal channels 13 and 14 joined side by side and radially superposed for feeding and returning the cooling water contained in the basin or pool 6. These channels 13 and 14 advantageously comprise sectional members 15 made from asbestos cement and arranged within the ducts 12 and a layer of insulating material 16 positioned between the ducts 12 separates the sectional members 15 arranged back to back within the channels 13 and the channels 14.

These cooling fluid flow channels extend in substantially vertical planes along the walls of the aforesaid vessels and the corresponding fluid feed channels 13 and fluid return channels 14 are joined together at their lower ends while communicating with each other substantially at the bottom level of said vessels. The upper ends of these channels are connected to substantially vertical ducts 17 and 18 extending through the lower roof 2 and the intermediate partition 5 and opening into the basin or pool 6, the duct 17 connected to the channel 13 opening below the free surface of the water contained within this basin and the duct 18 connected to the channel 14 opening above said free surface for the back flow of hot water. In order to provide coverage of substantially the whole surface of the bottom and roof or top of said vessels the stainless steel ducts 12 containing the channels 13 and 14 have differing lengths so that their ends are imbricated into each other in interfitting relationship thereby forming a substantially continuous surface. This arrangement is illustrated in particular in FIGS. 5 and 8 where have been shown and designated by the reference numerals 12*a*, 12*b*, 12*c*, respectively, the stainless steel ducts of small length, medium length and great length.

Figure 2:
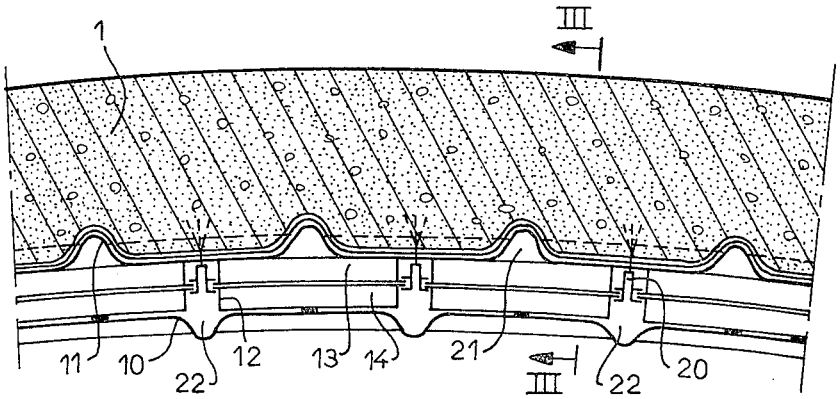
FIG. 2 is a partial view in cross-section taken upon the line II—II of FIG. 1.
Figure 3:
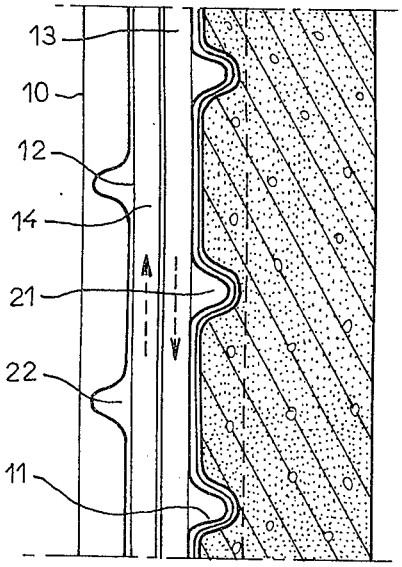
FIG. 3 is a fragmentary view in cross-section taken upon the line III—III of FIG. 2.
Figure 4:
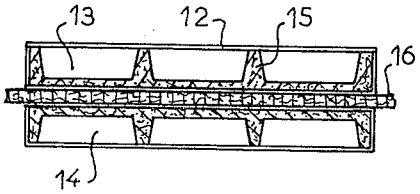
FIG. 4 is an enlarged view of a detail shown in FIG. 2, illustrating the channels for the circulation of the cooling fluid according to the invention.
Figure 5:
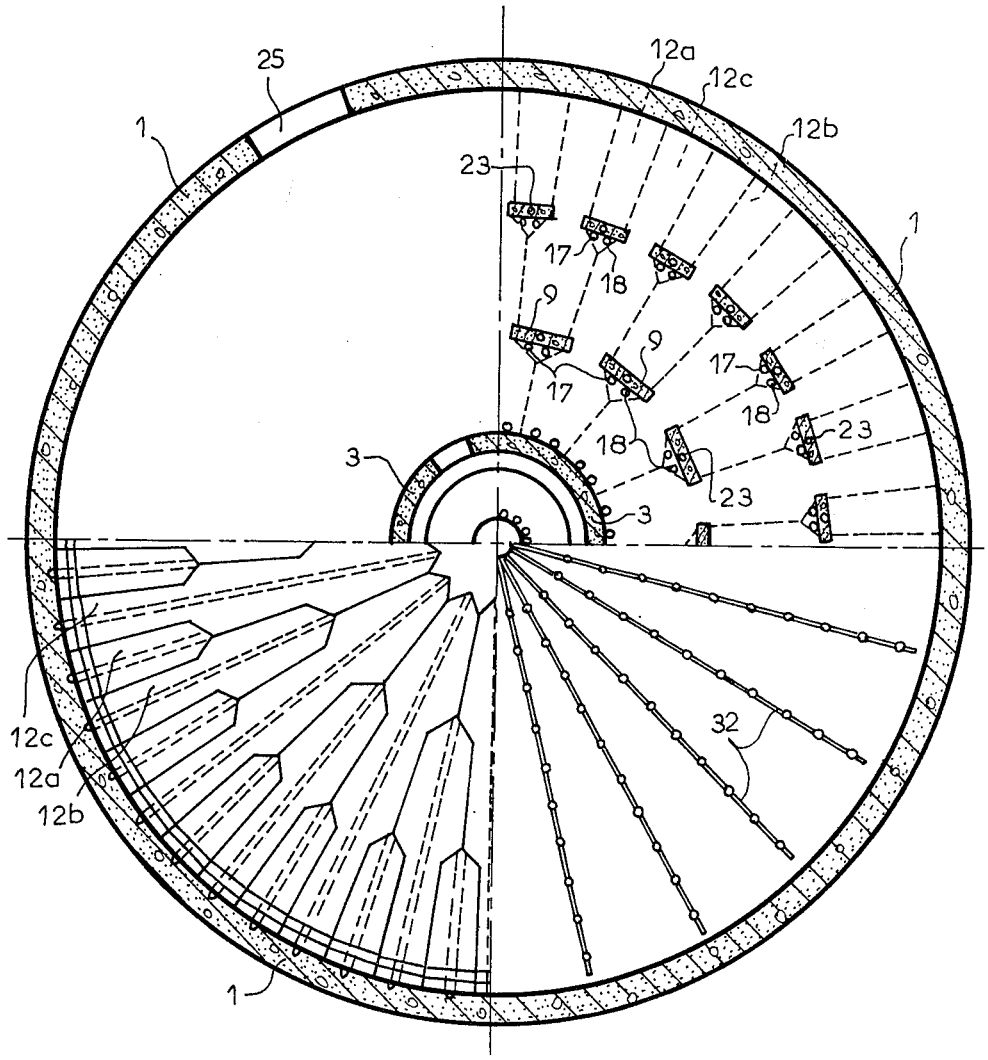
FIG. 5 is a view in cross-section taken at different levels of the confining enclosure shown in FIG. 1.
Figure 8:
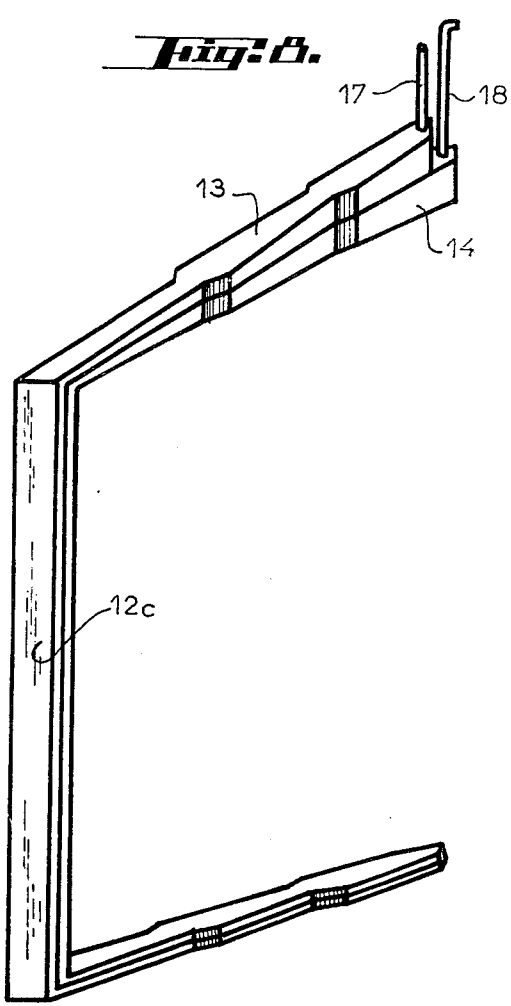
FIGS. 6,7 and 8 show various lengths of cooling channels used in this confining enclosure.
Figure 7:
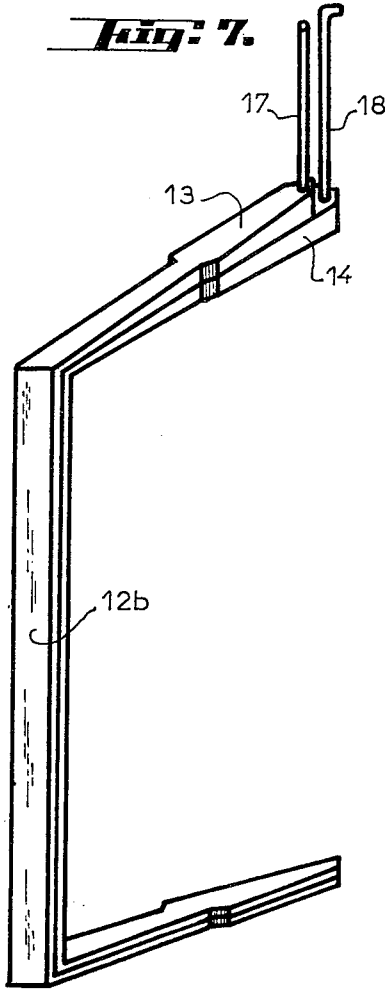
Figure 6:
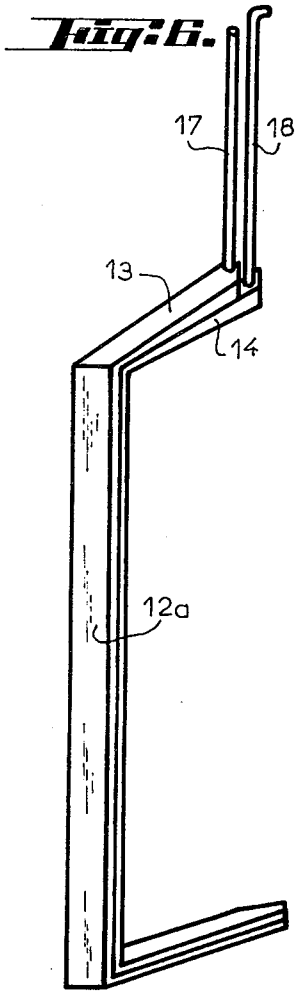

The first vessel 10 having a corrugated wall and which holds the radio-active products or waste is desirably secured by welding onto the radially inner face of the stainless steel ducts 12 as this may be seen in FIG. 2. These ducts 12 are secured in turn with their radially outer face by welding to the inner wall of the second corrugated vessel 11 and the latter may be secured as by welding onto anchoring stainless steel elements integral or rigidly connected with the walls of the outer reinforced concrete shell 1 and which are regularly distributed over the inner surface of the concrete shell. The inner surface of said reinforced concrete shell 1 is advantageously also corrugated to comprise series of corrugations similar to those of the corrugations of the second vessel 11, so that this second vessel 11 may be applied to and supported directly by the reinforced concrete shell. At 20 has been diagrammatically shown anchoring and support means for the ducts 12 forming the cooling fluid flow circulation channels. This arrangement offers the advantage that the substantially sealed or fluid-tight channels 21 are formed of and defined by the inner concave surfaces of the corrugations of the second vessel 11 and by the corresponding walls lying in front of the ducts 12. Likewise the channels 22 are formed of and defined by the concave surfaces of the corrugations of the first vessel 10, the correspoinding walls in front of the ducts 12 and the wall confronting the second vessel 11. The invention has advantageously contemplated to use these channels, 21 and 22 for cooling air circulation purposes the channels 21 located radially outwards being used to supply fresh air and the ducts 22 lying radially inwards being used for returning the hot air. These channels 21 and 22 are connected at their lower ends substantially at the bottom level of said vessels the upper ends of the channels 21 being connected to substantially vertical ducts 23 formed within the thickness of the concrete pillars 9 and opening above the free surface of the water in the basin 6 whereas the upper ends of the hot air return channels 22 open into the atmosphere by means of a Venturi nozzle 24 provided at the top of said vessels and contained within said chimney-stack.

The circulation of the cooling fluids is therefore effected through natural convection without any outer power supply. The cold air is drawn in by the ducts 23 above the free surface of the water contained within the basin 6 owing to the openings 25 provided for the passage of air in the wall of the shell 1 right underneath the upper roof 7 and located above the free surface of the water within said basin. The cold air therefore passes from duct 23 into the channels 21 provided by the corrugations of the second vessel 11 and it circulates within these flow channels 21 down to about the centre of the bottom of said shell where it passes into the channels 22 formed of the corrugations of the first vessel. It is then heated through contact with the wall of said vessel 10 holding the radio-active waste and flows upwards through these channels 22 to the Venturi nozzle 24 where it flows into the chimney-stack and is exhausted or rejected to the atmosphere. A filter or like stainer 26 is disposed within the chimney-stack and Venturi nozzle 24 and forms a trap for the radio-active dusts which could be carried along by the hot air issuing from the channels 22 in case of cracking or failure of the first vessel 10. The passage of hot air within the Venturi nozzle 24 causes a suction of fresh air through the holes 25 provided below the upper roof 7, thereby providing the circulation cycle for the cooling air. The circulation of cooling water is also carried by natural convection and its flow cycle is the following:

The cold water flows downwards through gravity within the duct 17 connected to the channel 13 which is provided adjacent to the wall of the second vessel 11. It circulates throughout the height of the vessel 11 and at the bottom level of this vessel passes into the corresponding duct 14 adjacent to the wall of the first vessel 10. The water is then heated up through contact with this wall and flows upwards throughout the height of the first vessel 10, passes into the duct 18 and is discharged into the basin 6 at the end of this duct 18. The fresh air drawn in through the openings 25 passes above the surface of the water contained in the basin 6 and the evaporation of the hot water present at the surface gradually cools the water of the basin in depth. The cold water collects on the bottom of the basin and flows off through gravity into the ducts 17. The circulation cycle for the cooling water is then closed. Such a cooling system comprises no movable part and does not require any pump for circulating the water. The heat evolved from the radio-active waste supplies all the power required for circulating the cooling air and water and the cooling thus achieved is related to the thermal energy evolved from the radio-active products or waste.

The surface of the water within the basin 6 is kept at a constant level by means of an overflow pipe 27 leading to the outside of the shell 1 and provided with a shut-off valve. On the other hand a water supply duct 28 opens through a hole of the upper roof 7 above the basin 6 and possibly enables to restore or replenish the water level within said basin.

The invention also comprises means for detecting possible leakages of the vessels or channels for circulating the cooling fluids as well as means enabling to prevent any contamination at the outside of the shell. In the case of a leakage in the first vessel 10 containing the radio-active products or waste such a leakage is detected forthwith by controlling or sensing the radioactivity of the hot air stream flowing into the Venturi nozzle 24. The circulation of cooling air is then immediately stopped, the channels 21 and 22 for circulating the cooling air are filled with fresh water and a steam ejector 30 located at the outlet of the Venturi nozzle 24 is used for creating a draught of fresh air through the orifices 25 above the surface of the water within the basin 6. The filter or strainer 26 located at the outlet of the Venturi nozzle 24 enables to retain or trap the radio-active dusts or particles carried along by the hot air stream.

In the case of leakages occurring in one of the water circulation channels the amount of steam or water vapour present in the hot air stream increases whereas the back flow rate of hot water through the cracked channel decreases. Thus this leakage may be detected or sensed. The damaged channel is then isolated as follows: the end of the duct 17 corresponding to the downward flow of cold water is caused to be connected to a duct opening above the free surface of the water in the basin 6. In the same manner the outlet of the corresponding duct 18 is connected to the inside of the chimney-stack through an additional pipe. The damaged water circulation channel is then converted into an air circulation channel thereby to allow to also cool that portion of the vessel 10 which is in contact with this channel. If such a cooling is not sufficient the temperature of this portion of the vessel will increase thereby resulting in a slight distorsion or strain of the corrugations provided at this location.

In order to prevent the formation of hot spots on the inner wall of the vessel 10 compressed air is blown into the inside of this vessel in the vicinity of the bottom thereof by means of a feed duct 31 and distribution ducts and nozzles 32 positioned right above the bottom of said vessel 10. This compressed air is used on the one hand to prevent the radio-active slurries, sludges or precipitates from settling onto the bottom of the vessel 10 and on the other hand from diluting the radio-active gases produced by the liquids themselves. The radio-active gases thus diluted are discharged or removed through the chimney-stack by means of a central duct 33 provided at the top of the vessel 10 and which opens into the inside of the Venturi nozzle 24. The radio-active gases are therefore diluted once more with the hot air flowing from the circulation channels 22 and once more with the cold air sucked in through the holes 25 before being discharged or vented to the atmosphere through the chimney-stack which has a sufficient height for the ambient radio-activity not exceeding an acceptable value. The duct 33 is also provided with a shut-off valve.

The enclosure also comprises a feed line 35 for supplying the radio-active liquids and enabling to fill the vessel 10 through gravity. The same line is used for emptying said vessel 10. The upward flowing stream of liquid is produced in this case by a steam ejector 36 the Venturi nozzle 37 of which is positioned within the vessel 10 adjacent to the lower end of the line 35. In the case where this stream ejector 36 could not operate it suffices to shut the valve of said duct 33 and to admit the compressed air into said vessel by means of the duct 31 and the nozzles 32. The increase in pressure above the surface of the radio-active liquid enables to empty the vessel 10.

Figure 9:
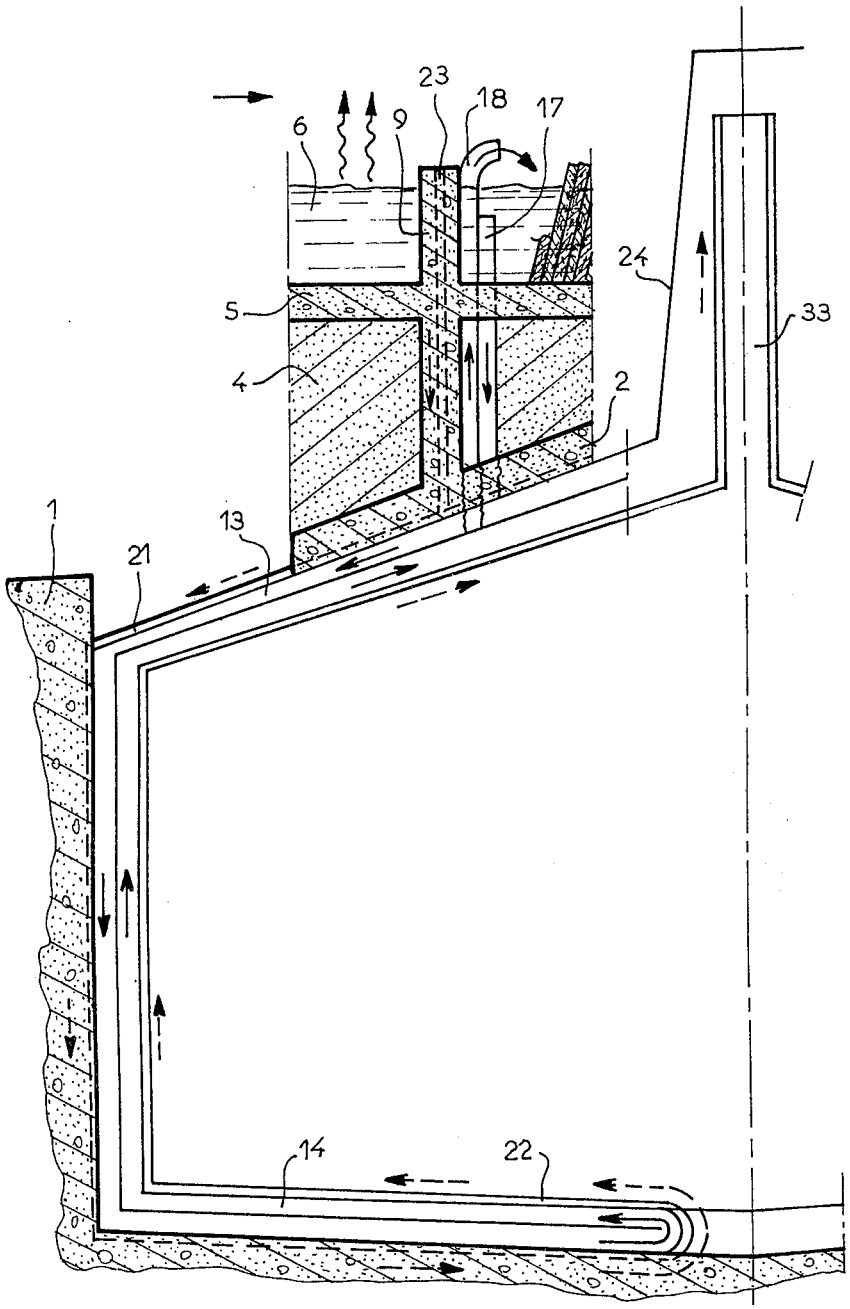
FIG. 9 is a sectional half-view diagrammatically illustrating the cooling of this confining enclosure.
Figure 11A:
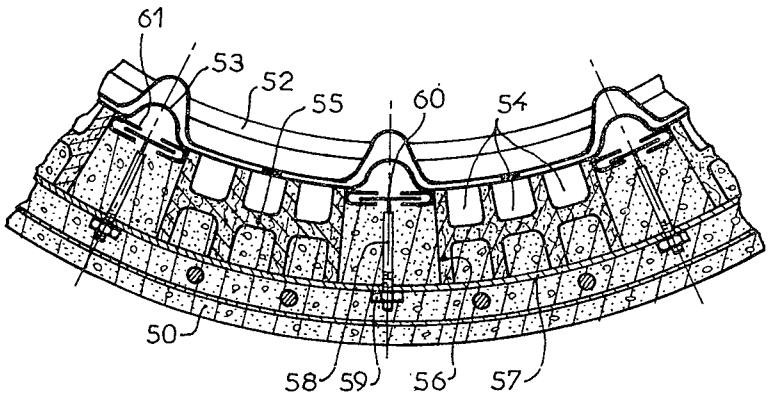
FIG. 11 is a partial enlarged view in cross-section through a wall of the enclosure shown in FIG. 10.
Figure 11B:
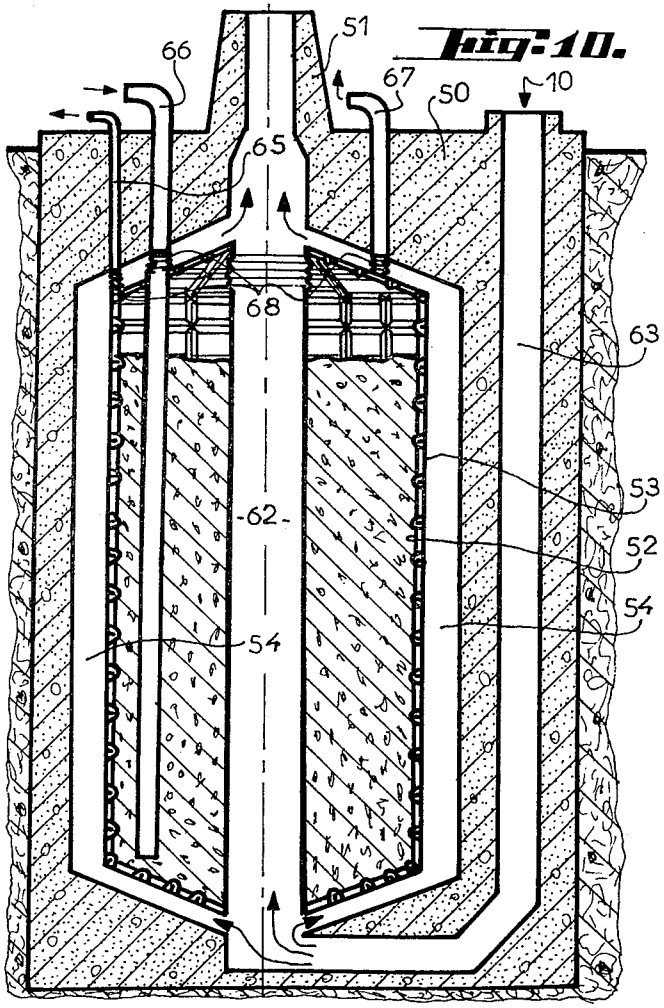

The radio-active liquids are therefore confined for ten years within the enclosure which has just been described with reference to FIGS. 1 and 9 and after this period of time they are withdrawn from said enclosure and artificially converted into powdery solid materials and confined within the enclosure which will now be described with reference to FIGS. 10 and 11.

It is of the same kind as the enclosure previously described for confining radio-active liquid products or waste to the extent that it also comprises an outer reinforced concrete vault 50 buried in the ground and opening to the atmosphere by means of a chimney-stack 51. This vault 50 forms the rigid supporting shell structure for both vessels 52 and 53 consisting of two thin corrugated stainless steel sheets formed for instance with two othogonally intersecting series of spaced parallel corrugations the inner vessel 52 holding powdery radio-active products or waste and the vessel 53 being located between the rigid supporting shell structure 50 and the inner tank or vessel 52.

In this instance the corrugations of the vessels 52 and 53 are directed radially to project inwards from the enclosure so that said vessels 52 and 53 are superposed to each other. The cooling fluid circulation channels 54 are located outside of the vessel 53 while being adjacent thereto. They consist advantageously of sectional members 55 made from fibro-cement the radially outer part 56 of which is embedded in concrete while being surrounded by clamping steel hoops or like binding steel bands or collars 57. The sectional members 55 are arranged in regularly spaced relationship all about said vessel 53 in front of the flat portions of the wall of this vessel. The spacing between any two adjacent sectional members 55 and which corresponds to the corrugations of the vessels 52 and 53 is at least partially filled with concrete to form the seatings for sliding anchoring means for said vessels. These sliding anchoring means comprise for instance each one a fastening rod 53 radially directed inwards from the enclosure and the outer end of which extends through the corresponding clamping or binding steel hoop 57 and is fitted with a bolt nut 59 threaded thereon. The opposite end of the rod 58 is fitted with a transverse plate 60 which is slidably mounted within grooves or slideways 61 rigidly connected to the outer wall of the vessel 53. These slideways 61 may consist of built-on parts welded to the outer wall of the vessel 53 on either side of a corrugation.

The inner vessel 52 is secured as by spot welding onto the flat portions of the walls of the vessel 53 and the whole assembly is thus secured by the sliding anchoring means just described.

As it may be seen in FIG. 10 the confining enclosure comprises a substantially vertical central duct 62 which extends through said vessels 52 and 53 and which opens with its outer end into the chimney-stack 51. At its lower end this central duct 61 is connected to a substantially vertical fresh air supply duct 63 which is provided within the thickness of the reinforced concrete vault 50 and which opens into the atmosphere slightly above ground level surface. At its bottom end this air feed duct 63 is joined on the one hand to the central duct 62 and on the other hand to said channels 54 located adjacent to the outer vessel 53. These channels 54 are also connected with their top ends to the bottom or base portion of the chimney-stack 51. The fresh air supplied by the duct 63 thus distributes between the vertical central duct 62 and the side channels 54; it is heated up through contact with the outer wall of the vessel 53 and is discharged or vented to the atmosphere through the chimney-stack 51. A draught of fresh air is thus created through the duct 63.

The small inner space left between the walls of the vessels 52 and 53 communicates with at least one duct 65 opening to the outside of the enclosure and which enables to effect a partial vacuum between both vessels. Thus any cracking or any damage, flaw or like impairment occurring in either of the vessels may immediately be detected or sensed by control of the relative pressure at the end of the pipe 65.

A pipeline 66 extends through the thickness of the vault 50 and into the inside of the vessel 52 downwards to the vicinity of the bottom thereof. This pipeline enables to fill said vessel with fluidized powdery radio-active products or waste the fluidizing air being discharged through a second pipeline 67 connecting the inside of the vessel 52 to the outside of the vault 50. Expansion joints 68 are of course provided at those connection areas where the aforesaid pipes 65, 66 and 67 are joined to the walls of the vessels 52 and 53.

The provision of the central duct 62 inside of the vessel 52 containing the radio-active products or waste enables to use vessels of larger diameter while retaining acceptable wall temperatures as the hotest spots are located between the central pipe 62 and the walls of the vessel 52 due to the fresh air circulation.

The pipe forming the central duct 62 is made from stainless steel as well as the sheets forming the vessels 52 and 53. In the same manner as in the previous example the power required for the circulation of the cooling fluid is supplied directly by the radio-active products themselves and the cooling of the stainless steel walls of the vessels varies according to the temperatures of these walls.

The enclosures for confining radio-active products or waste which have just been described are much less expensive than those known from the prior state of the art; they are much more reliable as the configuration of the corrugated wall vessels enables them to accept irregular local distorsions or strains and they are less subject to troubles in operation since the cooling devices and systems used do not comprise any movable parts and do not require any outer or extraneous power.

It should be understood that the invention should not at all be construed as limited to the forms of embodiment described and shown which have been given by way of illustrative examples only. In particular it comprises all the means constituting technical equivalents of the means described as well as their combinations if the latter are carried out according to its gist and used within the scope of the appended claims.

What is claimed is:

1. An enclosure for confining radio-active products, comprising in combination: a substantially fluid-tight outer rigid supporting shell structure made from reinforced concrete and buried in the ground and opening to the outside through a reinforced concrete chimney-stack; a first vessel containing said radio-active products which forms a primary barrier and consists of thin corrugated stainless steel sheet material formed with two orthogonally intersecting series of spaced parallel corrugations, a second vessel forming a secondary barrier made from thin corrugated stainless steel sheet material formed with two orthogonally intersecting series of spaced parallel corrugations and which is located between said rigid supporting shell structure and said first vessel; means for cooling said vessels through fluid flow circulation induced by natural convection within channels adjacent to at least one of said vessels and means for feeding and discharging said radio-active products into and from said first vessel.

2. A construction according to claim 1, wherein the corrugations of said first and second vessels are directed radially to project inwards and outwards, respectively, from said confining enclosure and cooling fluid flow circulation channels are provided in substantially parallel relationship with each other between said vessels and consist of stainless steel ducts forming in the longitudinal direction radially superposed fluid feed and return channels, the cold fluid feed ducts being adjacent to the wall of said second vessel and the hot fluid return ducts being adjacent to the wall of said first vessel.

3. A construction according to claim 2, wherein the superposed cooling fluid feed and return channels extend along substantially vertical walls of said vessels and over different lengths along the bottom wall and the top wall of said vessels so that all of said cooling channels cover substantially the whole surfaces of the walls of said vessel, the corresponding superposed fluid feed and return channels being joined to each other through their corresponding lower ends.

4. A construction according to claim 1, wherein the corrugations of said first and second vessels are directed radially to project inwards from said confining enclosure and fluid flow circulation channels are located to extend substantially vertically adjacent to the outer wall of said second vessel between said rigid supporting shell structure made from reinforced concrete and said second vessel.

5. A construction according to claim 4, comprising a substantially vertical fresh air supply duct provided within the thickness of said rigid supporting reinforced concrete shell structure and the lower end of which is connected on the one hand to said cooling fluid flow circulation channels located between said rigid supporting shell structure and said second vessel and on the other hand to the lower end of a substantially vertical central duct which extends through said vessels and opens to the outside through said chimney-stack.

6. A construction according to claim 4 for holding ratio-active powdery solid materials, wherein said first vessel is secured by spot welding to said second vessel which is secured in turn to said supporting shell structure by sliding anchoring means comprising each one a fastening rod rigidly affixed to said supporting shell structure and fitted at its radially inner end with a transverse plate slidably mounted within slideway grooves provided by built-on parts secured to the outer wall of said second vessel.

7. A construction according to claim 6, wherein sectional members made from fibro-cement form said cooling fluid flow circulation channels and are provided between the outer wall of said second vessel and said rigid supporting shell structure while being distributed between said sliding anchoring means and are surrounded externally by binding steel hoop clamping means also supporting the radially outer ends of said rods of said anchoring means.

8. A construction according to claim 2, for holding ratio-active liquids, wherein said first vessel is secured by spot welding onto the radially inner faces of the stainless steel pipes forming said cooling channels which are in turn secured by welding onto the inner face of said second vessel, the latter being affixed by welding onto stainless steel anchoring members uniformly distributed in said supporting reinforced concrete shell structure.

9. A construction according to claim 8, wherein said reinforced concrete supporting shell structure comprises a first roof in the middle of which is formed the base of said chimney-stack, a layer of insulating material such as dry sand being disposed above said first roof and extending substantially to ground level while having a thickness large enough for shielding against the radiations emitted by said radio-active products; whereas a basin forming a cooling water storage tank is provided above said layer of insulating material slightly above ground level on an intermediate partition, said basin being covered by a second reinforced concrete roof topping said rigid supporting shell structure and in the middle of which is formed the upper portion of said chimney-stack.

10. A construction according to claim 8, comprising cooling air flow circulation channels which are defined by the concave surfaces of the corrugations of said first and second vessels and by the corresponding surfaces of the stainless steel ducts forming the cooling water flow circulation channels, the cold air passing within the corrugations of said second vessel and the hot air flowing upwards within the corrugations of said first vessel, the hot air passageway channels being in communication with the outer atmosphere through Venturi nozzle means located inside of said chimney-stack, whereas filtering strainer means forming a trap for radio-active dusts and particles are provided at the outlet of said chimney-stack.

11. A construction according to claim 9, wherein said second roof of the reinforced concrete supporting shell structure comprises holes for providing communication with the ambient atmosphere and said chimney-stack comprises holes of communication with the free space left between said second and first roofs so that the hot air issuing from said chimney-stack and flowing from the channels constituted by the corrugations of said first vessel creates a draught of fresh air on the surface of said basin forming a cooling water storage tank.

12. A construction according to claim 11, wherein said fresh air feed and hot water return channels open above the free surface of the water within said basin whereas said cold water feed channels open below the free surface of the water within said basin.

13. A construction according to claim 8, comprising compressed air blowing means within the bottom wall of said first vessel for preventing radio-active solid particles contained within the radio-active liquids of said first vessel from settling and depositing on the walls of said first vessel.

14. A construction according to claim 13, wherein said first vessel comprises an upper outlet opening for the exit of compressed air and radio-active gases, said opening being located within said chimney-stack and being provided with shut-off valve means.

15. A construction according to claim 8, comprising sensing means for detecting leakages in said vessels and said cooling fluid circulation channels and means for preventing any contamination of the ambient atmosphere in case of leakage of either of said vessels and said cooling fluid circulating channels.

* * * * *